United States Patent [19]

Lau

[11] Patent Number: 5,020,599

[45] Date of Patent: Jun. 4, 1991

[54] DRILLING TOOL

[75] Inventor: Werner Lau, Cults, Scotland

[73] Assignee: The Red Baron (Oil Tools Rental) Limited, Aberdeen, Scotland

[21] Appl. No.: 488,090

[22] PCT Filed: Jan. 11, 1989

[86] PCT No.: PCT/GB89/00019

§ 371 Date: Jun. 22, 1990

§ 102(e) Date: Jun. 22, 1990

[87] PCT Pub. No.: WO89/06737

PCT Pub. Date: Jul. 27, 1989

[30] Foreign Application Priority Data

Jan. 12, 1988 [GB] United Kingdom ..... 8800572

[51] Int. Cl.[5] ..... E21B 31/20

[52] U.S. Cl. ..... 166/301; 166/98; 294/86.22

[58] Field of Search ..... 166/98, 301; 294/86.1, 294/86.15, 86.17, 86.22

[56] References Cited

U.S. PATENT DOCUMENTS 3,618,177 11/1971 Wood ..... 294/86.17 X 4,706,745 11/1987 Bishop et al. ..... 166/98

*Primary Examiner*—William P. Neuder

*Attorney, Agent, or Firm*—Marshall, O'Toole, Gerstein, Murray & Bicknell

[57] ABSTRACT

A tool for use in an oil or gas well to retrieve a drilling or production string from the well, said tool comprising an assembly which can be mounted on a supporting string, a driven member carried by the assembly and responsive to vertical movement of the assembly, to be driven in a predetermined rotational direction, said driven member being provided with or supporting a self-tapping thread provided at the lowermost end of the assembly, the self-tapping thread having the same sense as said predetermined direction of rotation.

19 Claims, 4 Drawing Sheets

DRILLING TOOL

The present invention relates to a drilling tool, but more particularly relates to a tool intended for use in connection with the drilling of an oil or gas well.

In a typical oil or gas well, when the well has been drilled, the interior of the well is lined with a tubular casing. Typically the casing is formed from pipe sections which are of decreasing sizes at increased depth The casing is used to support the sides of the bore.

Running through the center of the well will be a drilling string or a production string, again consisting of numerous tubular elements which are connected together. The tubular pieces of the drilling string or the production string are screwed together, each tubular member having a right-handed threaded projection or "pin" at its lower end, and a box, at its upper end, provided with a threaded bore adapted to receive the right-handed threaded pin at the lower end of the next adjacent tubular element.

During the life of the well, or during the drilling procedure, there may be a need to remove, to the surface, the drilling string or the production string. This is normally accomplished by lifting the drilling or production string and successively unscrewing the tubular members that form the string as they reach the surface. However, it can happen that the drilling string or the production string becomes stuck or lodged in some way within the well, and this prevents the string from being pulled to the surface. For example, due to subterranean pressures, it is possible that the outer casing which supports the sides of the well may fail, and if the casing or formation does collapse in this way, pressure will be applied directly to the drilling or production string, thus preventing any movement of the string.

In such a case it is necessary to clear the obstruction, but firstly all the pipe in the drilling or production string above the obstruction must be removed and taken to the surface. It is not possible to accomplish this merely by pulling upwardly on the production or drilling string, but instead the top of the string above the obstruction must be moved counter-clockwise in order to unscrew one of the couplings between the interconnected lengths of pipe forming the drilling or production string. It will be understood that the "loosest" screw-threaded connection will unscrew, and whilst this may be the connection located immediately above the obstruction, this is unlikely. Thus, in a typical case, only part of the drilling string or production string above the obstruction will be removed from the well, leaving another part of the string within the well.

In order to recover this part of the drilling or production string that remains in the well it is not possible to lower a fresh string and re-establish contact by screwing a right-handed pin at the lower end of the fresh string into the box at the top of the remaining length of string, since again the complete string cannot be lifted, and it will again be necessary to perform an unscrewing operation before lifting the string, and such an unscrewing operation is unpredictable in that the "loosest" connection in the complete string will unscrew.

It has been proposed to remove the remaining part of the drilling or production string, in such a situation, using a special recovery string formed of tubular parts all inter-connected with left-hand threads. Thus the string can be rotated in a counter-clockwise direction without any fear of the connections in the recovery string from becoming undone. The lower end of the recovery string engages the box at the top of the remaining length of string, and thus the top of this remaining length of string is rotated in a counter-clockwise direction, thus again unscrewing the "loosest" connection between the top of the string and the obstruction. This procedure can be repeated several times until the entire length of the remaining string has been removed from the well. However, this proposal does have the disadvantage that a separate recovery string has to be maintained, having left-hand threads.

A further proposal involves the use of a special tool, known as a "reversing" or "back-off" tool which is adapted to convert a clock-wise rotation or drive in a recovery string into an anti-clockwise drive. The use of such a tool eliminates the need for a special recovery string of left-hand threaded pipe sections, since the conventional right-hand thread pipe sections can be used as the recovery string.

A conventional reversing or "back-off" tool comprises a combination of planetary gearing and anchoring systems. It is capable of converting a right-hand torque from the surface to a left-hand torque below the reversing tool, and thus can apply a left-hand torque to the sections of pipe to be recovered.

It is to be understood that a reversing tool of this type may be utilised in a similar way to the left-hand threaded recovery string in that the tool is brought into contact with the top of the remaining string and is then operated to rotate the top of the remaining string in a counter-clockwise direction, thus unscrewing the "loosest" connection in that remaining string. The procedure may be repeated until all of the remaining string has been removed from the well.

A disadvantage of existing reversing or back-off tools is that the gearing arrangement has to be relatively small in order to fit into the well casing, and thus the gearing is inherently weak. Consequently, the amount of torque that can be transmitted through the gearing is often insufficient to perform the desired disconnection function. The gearing arrangement may fail if subjected to excess torque.

According to one aspect of this invention there is provided a tool for use in an oil or gas well to retrieve a drilling or production string from the well, said tool comprising an assembly having means to mount the assembly on a supporting string, means within the assembly to drive a driven member carried by the assembly, in response to vertical movement of the assembly, in a predetermined rotational direction, wherein said driven member is provided with or supports a self-tapping thread provided at the lower-most end of the assembly, the self-tapping thread having the same sense as said predetermined direction of rotation, and wherein the tool is suspended from a suspension unit which has means to engage a casing to prevent rotation of the suspension unit whilst permitting vertical movement of the tool.

Preferably said predetermined direction of rotation is anti-clockwise, when the tool is viewed from above.

Thus by moving the tool vertically downwards the tool may be used to effect a screw connection in the left-hand sense with a remaining drill or production string in an oil or gas well.

Preferably the suspension unit which mounts the assembly on the drilling string comprises an elongate shaft of non-round cross-section and an anular member or assembly with a corresponding interior cross-section mounted thereon, said member or assembly being adapted to grip a casing. When the member or assembly grips the casing the non-round shaft can move axially, but cannot rotate.

Conveniently the suspension unit comprises a shaft passing through a sleeve, the shaft and the sleeve being such that the shaft cannot rotate relative to the sleeve, but can move axially of the sleeve, the sleeve being provided with wedge means to engage a casing.

Preferably said drive means comprise at least one helical recess and at least one projection inter-engaging with said recess, the recess and projection being provided on said driven member and on part of the tool which is prevented from rotation during downward operative motion of the tool to generate rotation of said driven member. The or each projection may also be of part helical form. Preferably there are three equiangularly spaced recesses and projections.

Conveniently the said part of the tool is in the form of an annular member which surrounds a shaft formed on the driven member, the annular member and the shaft being provided with the said inter-engaging projection and recess.

Preferably means are provided to permit rotation of said part of the tool relative to said driven member, when the tool is lifted.

Conveniently said rotation permitting means comprise a ratchet arrangement constituting a connection between said part and a main housing of the tool, said ratchet arrangement being such that said part is able to rotate in one sense, but is not able to rotate in the opposite sense.

Advantageously said ratchet arrangement comprises a substantially cylindrical ratchet member, said ratchet member being provided with teeth, at one end, adapted to engage corresponding teeth formed on said part, the ratchet member being biased into engagement with said part by appropriate biasing means, the teeth being configured so that on relative rotation between said part and said ratchet member in one direction, said teeth engage, whereas on relative rotation in the opposite direction said teeth provide a camming effect, driving the ratchet member away from said part against said bias, to permit relative rotation between said part and said ratchet member.

Preferably said ratchet member is provided with means which engage part of the housing of the tool to prevent rotation of the ratchet member relative to the housing, said means comprising co-operating projections and recesses which permit axial movement of the ratchet member.

Conveniently said projections comprise splines or castellations formed on the main housing of the tool and correspondingly shaped recesses formed on the outer surface of the ratchet member.

Advantageously said ratchet member is biased towards said part by springs which engage the ratchet member and which also engage a projection formed on the housing of the tool.

The invention also relates to a method of retrieving drilling or production string from a well, said method comprising the steps of utilising a tool according to said one aspect of the invention, and lowering the tool to effect rotation of said self-tapping thread to secure engagement between the self-tapping thread and the upper-most part of the drilling or production string, and continuing to effect rotation of said self-tapping thread until part of the drilling or production string to be recovered is unscrewed from the remaining part thereof, and lifting the tool and the disconnected part of the drilling or production string to the surface.

In order that the invention may be more readily understood, and so that further features thereof may be appreciated, the invention will now be described, by way of example, with reference to the accompanying drawings in which.

Figure 1:
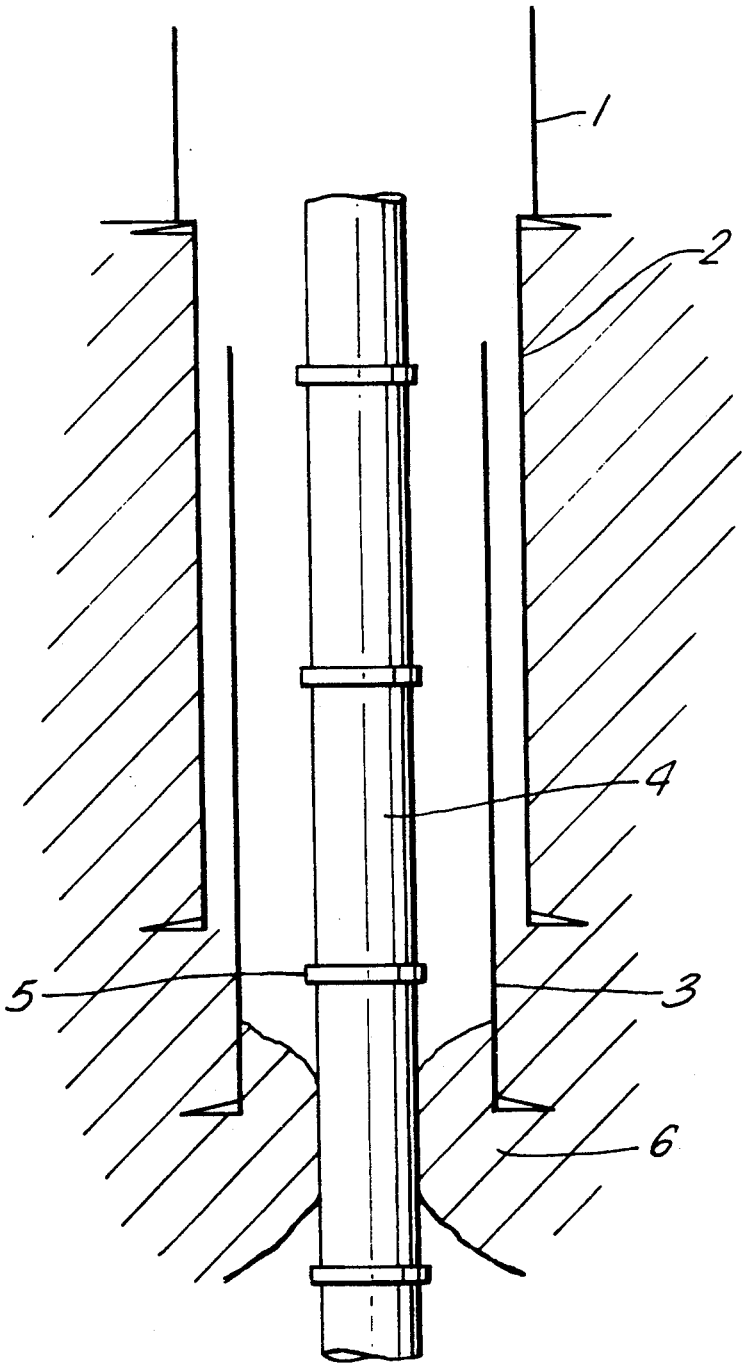
FIG. 1 is a diagrammatic view of an oil or gas well in which the casing or formation has collapsed.

Referring initially to FIG. 1, a oil or gas well consists of an outer casing formed from inter-connected tubular portions 1, 2, 3; the tubular portions being of decreasing size, with increasing depth, as is conventional.

Contained within the casing is a tubular string which may be a drilling string or a production string.

The tubular drilling or production string 4 is formed of integral tubular members which are inter-connected 5 by means of a right-hand screw threaded portion or so-called "pin" at the lower end of each tubular element being inserted into a corresponding box, provided at the upper end of each member and defining a threaded bore adapted to receive the pin at the lower end of the next adjacent tubular member. The casing within which the drilling or production string 4 is running is shown to have collapsed 6 thus causing material from the adjacent rock formation to enter into the casing and apply pressure directly to part of the drilling or production string 4. It is thus necessary, in order to clear the resulting obstruction, to remove all of the drilling or production string 4 which is located above the connection 5 immediately above the obstruction 6.

As a first step in removing the drilling or production string, the drilling or production string will be pulled towards the surface and will be rotated in a counter-clockwise or left-hand sense, thus undoing the "loosest" connection 5 in the drilling or production string. The lengths of pipe forming the drilling or production string above that "loosest" connection can thus be removed from the well. In order to remove the remaining part of the drilling or production string above the obstruction 6, a tool in accordance with the invention may be utilised.

Figure 2:
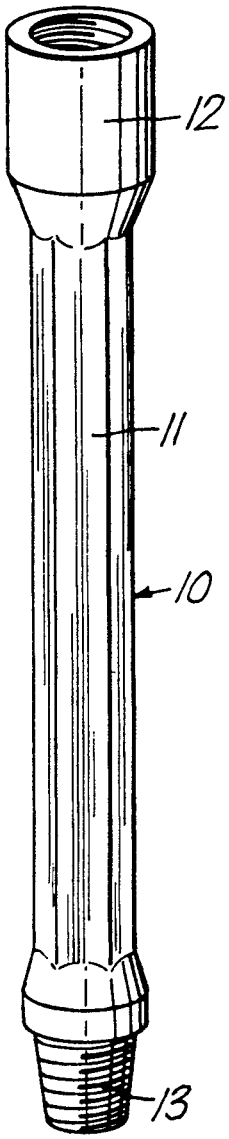
FIG. 2 is a diagrammatic view of a part of a suspension unit for suspending a tool in accordance with the invention

Referring now to FIG. 2, a tool in accordance with the invention may be suspended by means of a suspension unit. The suspension unit may comprise a central tubular shaft 10 having a non-round exterior cross-section, and preferably having an exterior cross-section defined by a plurality of faces. Thus, as illustrated, the exterior of the tubular shaft 10 is of hexagonal form, having flat faces 11. However, in alternative embodiments of the invention the shaft may have other non-round cross-sections, and may thus be octogonal, or square, or even oval.

At its upper end the shaft is provided with a threaded box 12 for connection to the next-adjacent part of a recovery string, and at its lower end is provided with a projecting threaded pin 13 for connection to the remaining part of a tool in accordance with the invention, as will be described. The upper box 12 may be replaced by a threaded pin if desired.

The hexagonal portion of the tubular member 10 is surrounded by a sleeve 14 having a hexagonal interior, so that there may be no rotation between the sleeve and the hollow shaft 10. The sleeve 14 is provided with means to engage the casing to lock the sleeve in position. The design of the sleeve is such that the hexagonal shaft 10 may execute a vertical movement through the sleeve when the sleeve is locked in position.

Figure 3:
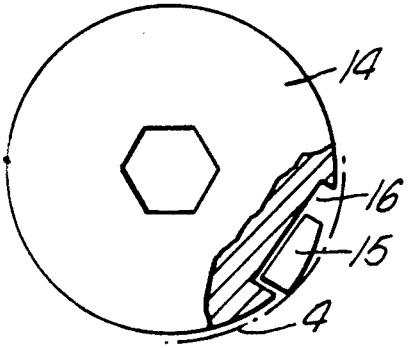
FIG. 3 is a partially cut-away top plan view of the part shown in FIG. 2.

Referring to FIG. 3 the exterior of the sleeve 14 is provided, at an appropriate position, with three equiangularly spaced wedges 15 (only one of which is shown), the wedges each being received in a recess the base of which is inclined at an angle to the tangent to the periphery of the sleeve 14.

Figure 4:
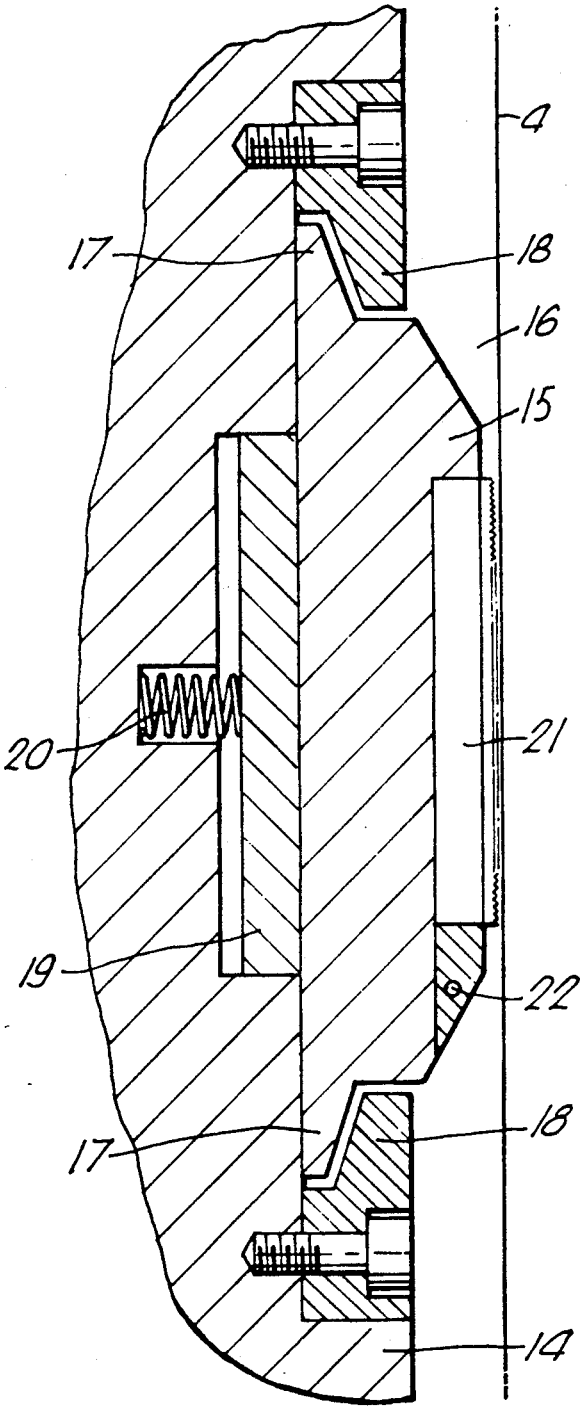
FIG. 4 is an enlarged vertical view of the wedge of FIG. 3.

As can be seen more clearly in FIG. 4, the wedge 15 is received within a recess 16, the wedge having projecting upper and lower portions 17 which are engaged by retaining elements 18 which are screwed to the main body of the sleeve 14 by means of appropriate screws. A plate 19 is located within a cut-away region formed in the base of the recess 16, the plate being biased outwardly by means of a spring 20.

Mounted on the exterior surface of each wedge is a serrated element 21 which is mounted on the rest of the wedge 15 and is retained in position by means of a shear pin 22.

The wedge is designed to engage with the casing 4 of a well, and the sleeve 14 is selected to have a diameter slightly less than the interior diameter of the casing 4 that is to be engaged.

It will be appreciated, on considering FIG. 3, that if the described suspension unit is lowered into a casing, and is rotated in an anti-clockwise direction, even though the wedge 15 is urged outwardly by means of the spring 20 and the associated plate 19, the outer serrated surface of the element 21 will only be urged lightly into contact with the casing, and will not prevent rotation of the suspension unit. However, if the suspension unit is rotated in a clockwise direction, the wedge 15 will tend to move towards the shallower end of the recess 16, and thus the serrated element 21 will tend to grip the casing more tightly. As the serrated element 21 grips the casing more tightly, so the wedge is moved more firmly towards the narrow end of the recess 16. The plate 19 and/or the rear face of the wedge 17 may be coated with a non-stick material, such as polytetrafluoroethylene as sold under the trade mark TEFLON to ensure that the wedge can slide smoothly across the plate 19. Thus the locking effect provided by the wedge may be amplified. Thus the sleeve 14 may be locked in position in such a way that clockwise rotation of the shaft 10 may be prevented, whilst the shaft 10 can still be moved axially through the sleeve 14.

When the sleeve is to be released, the shaft is rotated in an anti-clockwise direction which should cause the wedges to dis-engage. However, if it is not possible to release the wedges, if a significant upward pull is applied to the string, the shear pins 22 in each wedge 15 will break, and thus the element 21 having a serrated outer face will be able to be separated from the rest of the wedge, enabling the entire string to be lifted. Of course, the serrated elements 21 will be lost if this expedient is adopted.

It will be appreciated that, in use, the sleeve will be engaged with the casing 4 at an appropriate position, to enable the shaft 10 to be moved up and down, for the purpose that will be described hereinafter.

Figure 5:
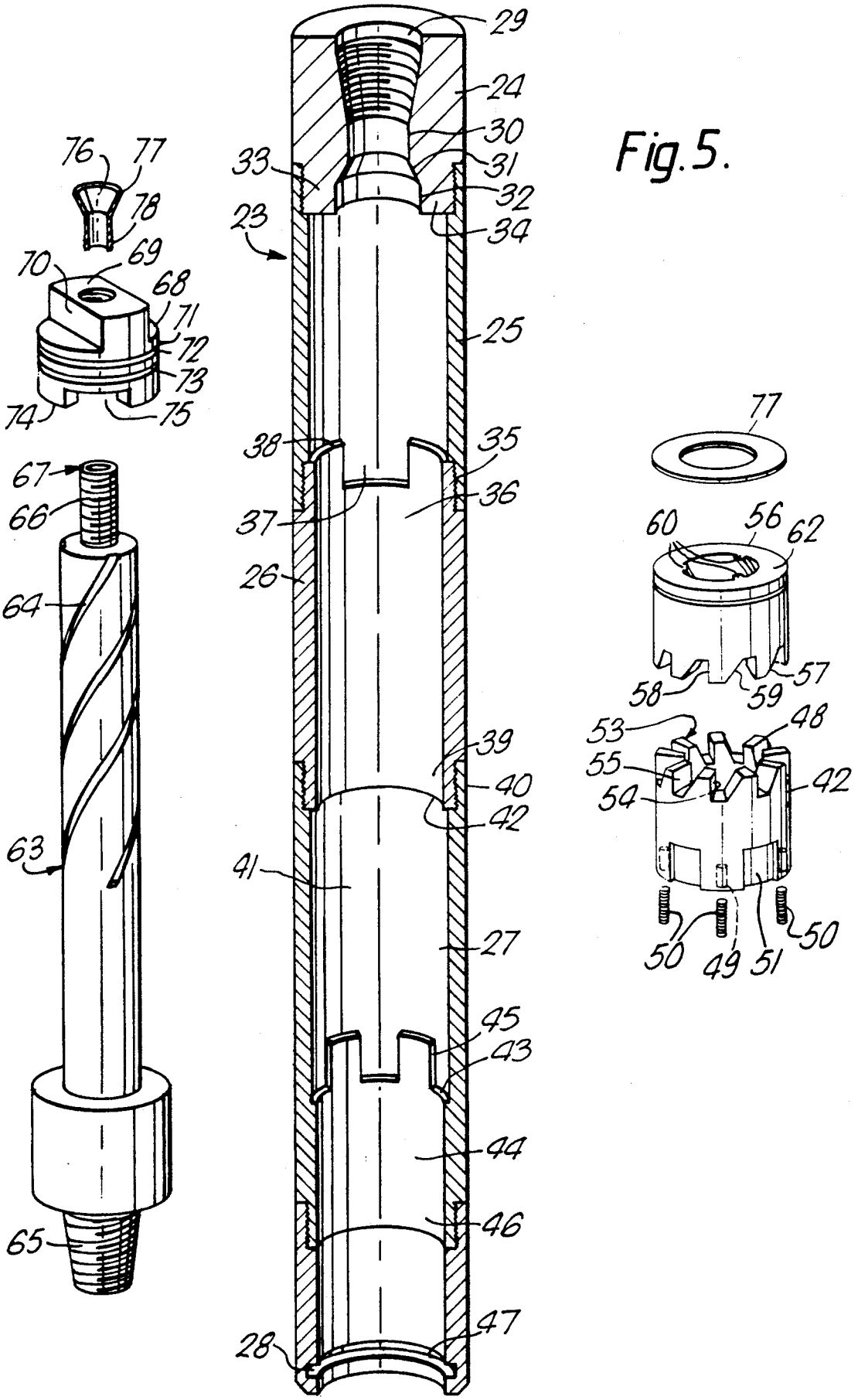
FIG. 5 is an exploded part sectional view of one embodiment of the invention.

Referring now to FIG. 5, the main part of a tool in accordance with the invention comprises various components which are assembled together.

The tool comprises an axial tubular housing 23 formed from five interconnected tubular components 24, 25, 26, 27 and 28.

The uppermost tubular component 24 is a connection component provided, at its upper end, with internal threading 29 adapted to being engaged with the threading provided on the threaded pin 13 as described above in FIG. 2. The internal threading 29 is of a tapering or inverted conical form. The threading 29 leads to a vertical bore or passage 30 of uniform cross-section which terminates, at its lower end, with an outwardly flaring portion 31 which again merges into a final tubular portion 32. The flaring portion 31 and the tubular portion 32 are contained within a lower projection 33 formed on the component 24, this projection 33 having an exterior thread.

The thread on the exterior of the projection 33 engages a corresponding threaded portion 34 provided at the top of the second tubular component 25. This second tubular component 25 has internal threading 35 provided at its lower end.

The third component 26 is provided with a threaded portion at its upper end which is engaged with the screw threading 35 provided on the component 25. However, the internal diameter of the passage 36 extending through the component 26 is less than the diameter of the corresponding passage extending through the component 25. The upper end of the component 26 presents a plurality of rectangular recesses 37 in a horizontal surface or "step" 38 within the interior of the housing 23.

The lower end of the component 26 is in the form of a projection 39 which has exterior threading. This projection 39 is engaged with corresponding threading 40 provided at the top of the component 27. The diameter of the passage 41 passing through the component 27 is greater than the diameter of the passage 36 passinging through the component 26 and thus the lower end of the projection 40 presents a horizontal surface 42, facing downwardly, but otherwise corresponding to the horizontal surface or step 38.

The interior of the tubular component 27 defines, intermediate its ends, an inwardly directed step 43 which defines the upper edge of a lower region 44 of the tubular portion 27, the lower region 44 having a lesser internal diameter than the internal diameter of the rest of the tubular portion 27.

The step 43 is provided with upwardly directed castellated projections or splines 45 which are evenly spaced around the outer periphery of the step 43, the projections 45 thus being formed integrally with the wall of the tubular component 27. The radial dimension of the splines 45 is equal to the radial extent of the step 43.

The lower end of the tubular component 27 is provided with a downwardly extending projection 46, the exterior of which is threaded and is inserted into an open internally threaded mouth provided at the top of the lower-most tubular component 28. The lower end of the tubular component 28 is provided with an internal groove 47, to contain a sealing or "O" ring of an appropriate resilient material. A plurality of such grooves may be provided if so desired.

Received within the housing 23 is a tubular ratchet member 48. The ratchet member 48 is dimensioned to be received within the region of the tubular component 27 located above the step 43. The ratchet member 48 is of tubular configuration, and is provided, at its lower end with a plurality of vertical bores 49 each adapted to receive a coiled spring 50, with part of the spring projected downwardly. Intermediate the bores 49 the outer surface of the tubular ratchet member 48 is cut away to form generally square recesses 51, the recesses corresponding in shape, size and spacing to the projections or splines 45.

In the outer wall of the tubular ratchet member 48 an axially extending slot 52 is provided adapted to receive a locating pin.

The upper part of the ratchet member 48 is provided with a plurality of upwardly extending projections 53. The projections, when viewed from the side of the ratchet member 48, each have a substantially vertical leading edge 54, located towards the right-hand side, and an inclined trailing edge 55, located to the left-hand side.

Ratchet member 48 is received within the upper portion of the tubular element 27 with the recesses 51 engaged with the projections or splines 45. A retaining pin is then passed through an appropriate radial bore formed in the tubular component 27, and the end of the pin is engaged in the axial slot 52. The ratchet member is normally biased upwardly by means of the springs 50 contained within the bores 49, which engage the step 43. The ratchet member can move vertically but the permitted degree of movement of the ratchet member is such that the projections or splines 45 are always at least partly engaged within the recesses 51. Thus the ratchet member cannot rotate relative to the housing 23.

A tubular drive member 56 is also located within the tubular housing 23. The drive member 56 is provided, at its lower end, with projections 57. The projections 57 are, effectively, of a configuration which is the reverse of that of the projections 53, and thus each projection 57 has a configuration which is equivalent to the configuration of the space between two adjacent teeth 53. Thus each projection 57 has a vertical face 58 to the left-hand side, and an inclined face 59, to the right-hand side, when the projection is viewed from the side.

Figure 6:
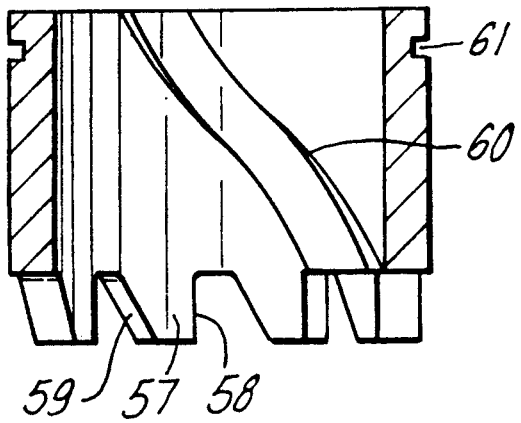
FIG. 6 is a sectional view of a drive member forming part of the tool of FIG. 5, and FIG. 7, a diagrammatic view illustrating the engagement between the drive member and the ratchet member of the arrangement of FIG. 5.

The interior of the tubular drive member 56 is provided with three radially inwardly directed ribs 60, each of part helical form. The configuration of the ribs 60 can be seen more clearly in FIG. 6 which is a sectional view of the drive member 56.

The drive member 56 is provided with an outer circumferential groove 61 and is received within the upper portion of the tubular component 27 of the housing 23 in a position above that occupied by the ratchet member 48.

A securing pin may pass through an appropriate radial bore formed in the tubular component 27 and into the circumferential groove 61. Thus the drive member 56 is capable of rotation, but is not capable of axial movement.

The ratchet member 48 and the drive member 56 are so dimensioned that when positioned within the housing 23, when the teeth 57 on the ratchet member 48 are engaged within the spaces between the teeth 57 on the drive member 56, the ratchet member 48 is biased upwardly by the springs 50 so that there is a space between the lower-most surface of the tubular ratchet member 48 and the inwardly directed step 43, the height of that space being slightly greater than the height of the teeth 53.

Also received within the housing is part of a driven element consisting of an elongate shaft 63 provided, on its exterior surface, with a plurality of grooves 64 of helical form. The grooves are provided at the top of the shaft 63. The lower region of the shaft 63 is smooth. At its lower end the shaft terminates with a left-hand threaded pin 65 which maybe a pin having self-tapping threads, or which may be connected to a further tubular element terminating with a left-hand threaded pin having self-tapping threads.

Provided at the upper end of the shaft 63 is an exteriorly threaded boss 66 which is of less diameter than the diameter of the shaft 63. The shaft 63 has an axal bore, the upper part of which is threaded 67.

Received on the threaded boss 66 is a nut 68 provided with an upper projection 69 presenting opposed flat surface 70 for driving the nut. The nut has a lower portion 71 of circular cross-section provided with two outer peripheral circumferential grooves 72, 73, each adapted to receive a sealing or "O" ring of appropriate resilient material. The nut 68 has an under-surface 74 which is of greater radial extent than the shaft 63. Part of this under-surface is cut-away to form rectangular recesses 75. A supplementary or lock nut (not shown) may also be provided on the boss 66.

A funnel element 76 is mounted on the driven element 62. The funnel 76 has an open mouth 77 which is the same diameter as that of the bore 30, and has a threaded spout 78 which is inserted in the threaded part 67 of the bore through the shaft 63.

The driven element or shaft 63 is received within the housing 23, with the shaft 63 passing through the tubular ratchet member 48 and the tubular drive member 56. The inwardly directed ribs 60 on the drive member 56 are received within the helical recesses 64 formed on the exterior of the shaft 63. The under-surface 74 of the nut 68 is dimensioned to rest on and engage the step 38 provided in the tubular component 26 when the tool is in an initial position suspended within a well. However, the recesses 37 and 75 permit these components to be drivingly engaged, as will be explained.

The sealing or "O" ring contained within the groove 47, of the lower-most tubular element 28 of the housing 23 engages the smooth lower-most portion of the shaft 63, whereas the sealing or "O" rings in the grooves 72 and 73 provided on the nut 68 engage the smooth inner-surface of the tubular element 25 of the housing 23.

It will be noted that shaft 61 is hollow, having an axial bore therethrough, to permit the flow of mud or other fluid and a wire-line through the tool when it is in use. The mouth 77 of the funnel 76 is in the bore 30 to guide such fluid through the bore passing through shaft 63.

A thrust washer 77 is provided, which is located between the third component 26 and the fourth component 27, in contact with the horizontal undersurface 42. The washer 77 is dimensioned to engage the upper surface 62 of the drive member 56, but does not contact the driven element 63.

It is envisaged that, in use, the tool will operate as follows. Initially the tool, as described, is mounted on a conventionally drilling string, having right-hand threads, by engaging the described support assembly 10 on the string, the tool as illustrated in FIG. 5 being supported by the mounting assembly. The tool is then in a condition to be lowered down-hole. In this condition the weight of the driven element or shaft 63 will be supported by the engagement between the under-surface 74 of the nut 68 and the shoulder 38. The ratchet member 48 will be biased upwardly by the springs 50 contained within the bores 49 so that the teeth 53 of the ratchet member 48 engage with the recesses between the teeth 57 on the drive member 56. The upper surface 62 of the drive member 56 will abut the washer 77. If desired a separate member carrying a self-tapping left-hand screw thread is mounted on the lower end of the driven member 62.

The described assembly is then lowered downhole until the self-tapping thread at the lower-most end of the assembly comes into contact with the upper-most connector box of a length of drilling or production string remaining within the well casing. When this situation is reached the shaft 63 will commence an upward movement, but the shaft is not permitted to move upwardly freely by virtue of the engagement of the part-helical ribs 60 on the drive member 56 and the helical grooves 64 formed on the outer surface of the shaft 63 because the drive member 56 cannot move upwardly. It will be thus understood that as the shaft 63 starts to move upwardly relative to the housing 23, so the inter-engagement of the helical ribs and the helical grooves tends to impart to the drive member a clock-wise rotation, when viewed from above. Thus the flat faces 59 on the teeth 57 of the drive member 56 are brought into firm engagement with the flat faces 54 on the teeth 53 of the ratchet member 48. The ratchet member 48 is prevented from rotation by virtue of the engagement between the recesses 51 provided on the ratchet member 48 and the projections or splines 45 provided on the housing 23.

At this stage the housing 23 is prevented from rotation by virtue of the engagement of the support assembly and the case.

A downward pressure is now applied to the string supporting the tool. By virtue of the configuration of the support assembly, this downward pressure is transmitted to the outer housing 23 of the tool which starts to move downwardly. As this downward movement commences the horizontal under-surface 42 moves the washer 77 downwardly which engages the drive member 56 and moves it downwardly so this will tend to impart a clock-wise rotation to the drive member 56, when viewed from above, by virtue of the engagement of the part-helical ribs 60 and the helical grooves 64. However, this rotation is prevented, in the manner described above, and consequently as the main housing 23 of the tool moves downwardly, moving the drive member 56 downwardly, the shaft 63 rotates in an anti-clock-wise direction, when viewed from above.

Thus, as the string supporting the tool is pressed down, the self-tapping screw mounted at the bottom of the tool can engage the top of the part of the drilling or production string left in the well.

Figure 7:
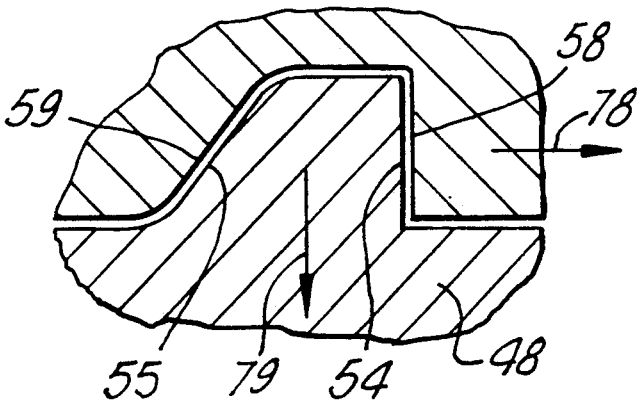

When the part-helical ribs 60 provided in the drive member reach the bottom of the helical grooves 64 formed in the shaft 63, the downward pressure is removed from the string supporting the tool, and the main housing 23 of the tool commences an upward movement as the string is pulled upwardly from the surface. As the main housing of the tool commences this upward movement the engagement between the ribs 60 and the grooves 64 is such that an anti-clock-wise motion is imparted to the drive member 56. This anti-clock-wise motion, as indicated by the arrow 78 in FIG. 7 brings the sloping face 59 of each tooth 57 on the drive member 56 into contact with the sloping face 59 on each tooth 53 of the ratchet member 48. The faces 59 and 55 are so inclined that a resultant downward force, indicated by the arrow 79, is generated, acting on the ratchet member, causing the ratchet member 48 to move downwardly against the upward bias provided by the springs 50 mounted with in the bores 49. As has been mentioned previously, the nature of these springs, and the nature of the recesses 51 when compared with the size of the projections or splines 45, is such that the ratchet member 48 can move downwardly by a distance equal to the height of the teeth 53. Consequently a rachetting effect occurs and, as the tool is lifted, the drive member 56 may rise relative to the shaft 63 and may also rotate about the axis of the shaft 63, so that the shaft 63 is not driven in a clock-wise direction as the tool is lifted, but maintains the same relative rotational and axial position.

It will be understood that when the tool has been lifted by a pre-determined amount, the tool is again in its initial condition, and the drill string can then again be pressed downwardly to repeat the cycle of operation described above.

On subsequent down-pressings of the string supporting the tool, the self-tapping thread is driven further into engagement with the top of the part of the drilling string remaining in the well. When the self-tapping thread has been driven fully home, subsequent cycles of operation will tend to unscrew the loosest or weakest point in that part of the drill or operating string that initially remained in the well. When the loosest joint has been fully unscrewed, the entire assembly, with part of the string to be retrieved hanging underneath it, may then be withdrawn from the well.

This entire operational procedure may be repeated until the connection 5 in the drilling or production string 4 immediately above the obstruction 6 is retrieved, and then other procedural steps may be adopted to remove the obstruction.

When the tool is lifted the horizontal upper-surface 38 on the housing 23 engages the under-surface 74 of the nut 68 to lift the driven member or shaft 63. By manipulating the tool the recesses 37 and 75 may be located to permit these components to be drivingly engaged. In this condition the shaft 63 may be driven in a clock-wise direction, should this be necessary.

It may prove convenient to let off a small explosive charge within the string in the region of the connection box immediately above the obstruction in order to loosen this particular connection, in the hope that this connection will then be the loosest in the remaining string.

Whilst the invention has been described with reference to one specific example, it is to be understood that many modifications may be effected without departing from the scope of the invention as defined by the following claims.

I claim:

1. A tool for use in an oil or gas well to retrieve a drilling or production string from the well, said tool comprising an assembly having means (12) to mount the assembly on a supporting string, means (56) within the assembly to drive a driven member (63) carried by the assembly, in response to vertical movement of the assembly, in a predetermined rotational direction, characterised in that said driven member (63) is provided with or supports a self-tapping thread (65) at the lowermost end of the assembly, the self-tapping thread having the same sense as said predetermined direction of rotation, and in that the tool is suspended from a suspension unit (10) which has means (14,15) to engage a casing (1,2,3) to prevent rotation of the suspension unit whilst permitting vertical movement of the tool.

2. A tool according to claim 1 wherein said predetermined direction of rotation is anti-clockwise, when the tool is viewed from above.

3. A tool according to claim 2 wherein the suspension unit (10) which mounts the assembly on the drilling string comprises an elongate shaft of non-round cross-section and an annular member (14) or assembly of corresponding interior cross-section mounted thereon, said member or assembly being adapted to grip a casing.

4. A tool according to claim 3 wherein the suspension unit comprises a shaft (10) passing through a sleeve (14), the shaft and the sleeve being such that the shaft cannot rotate relative to the sleeve, but can move axially of the sleeve, the sleeve (14) being provided with wedge means (15) to engage a casing.

5. A tool according to claim 1, 2, 3 or 4 wherein said drive means (56,63) comprise at least one helical recess (64) and at least one projection (60) interengaging with said recess, the recess and projection being provided on said driven member (63) and on part (56) of the tool which is prevented from rotation during downward operative motion of the tool to generate rotation of said driven member.

6. A tool according to claim 5 wherein the said part (56) of the tool is in the form of an annular member which surrounds a shaft formed on the driven member (63), the annular member and the shaft being provided with the said inter-engaging projection (60) and recess (64).

7. A tool according to claim 5 where means are provided to permit rotation of said part (56) of the tool relative to said driven member (63), when the tool is lifted.

8. A tool according to claim 7 wherein said rotation permitting means comprise a ratchet arrangement (53,59) constituting a connection between said part (56) and a main housing (27) of the tool, said ratchet arrangement being such that said part is able to rotate in one sense, but is not able to rotate in the opposite sense.

9. A tool according to claim 8 wherein said ratchet arrangement comprises a substantially cylindrical ratchet member (42), said ratchet member being provided with teeth (53), at one end, adapted to engage corresponding teeth (57) formed on said part (56), the ratchet member being biased into part by appropriate biasing means (50), the teeth being configured so that on relative rotation between said part and said ratchet member in one direction, said teeth engage, whereas on relative rotation in the opposite direction said teeth provide a camming effect, driving the ratchet member away from said part against said bias, to permit relative rotation between said part and said ratchet member.

10. A tool according to claim 9 wherein said ratchet member (42) is provided with means (51) which engage part (45) of the housing (27) of the tool to prevent rotation of the rotation member relative to the housing, said means comprising co-operating projections and recesses which permit axial movement of the ratchet member.

11. A tool according to claim 1 wherein the suspension unit (10) which mounts the assembly on the drilling string comprises an elongate shaft of non-round cross-section and an annular member (14) or assembly of corresponding interior cross-section mounted thereon, said member or assembly being adapted to grip a casing.

12. A tool according to claim 2 wherein the suspension unit comprises a shaft (10) passing through a sleeve (14), the shaft and the sleeve being such that the shaft cannot rotate relative to the sleeve, but can move axially of the sleeve, the sleeve (14) being provided with wedge means (15) to engage a casing.

13. A tool according to claim 11 or 12 wherein said drive means (56,63) comprise at least one helical recess (64) and at least one projection (60) inter-engaging with said recess, the recess and projection being provided on said driven member (63) and on part (56) of the tool which is prevented from rotation during downward operative motion of the tool to generate rotation of said driven member.

14. A tool according to claim 13 wherein the said part (56) of the tool is in the form of an annular member which surrounds a shaft formed on the driven member (63), the annular member and the shaft being provided with the said inter-engaging projection (60) and recess (64).

15. A tool according to claim 14 wherein means are provided to permit rotation of said part (56) of the tool relative to said driven member (63) when the tool is lifted.

16. A tool according to claim 15 wherein said rotation permitting means comprises a ratchet arrangement (53,59) constituting a connection between said part (56) and a main housing (27) of the tool, said ratchet arrangement being such that said part is able to rotate in one sense, but is not able to rotate in the opposite sense.

17. A tool according to claim 16 wherein said ratchet arrangement comprises a substantially cylindrical ratchet member (42), said ratchet member being provided with teeth (53), at one end, adapted to engage corresponding teeth (57) formed on said part (56), the ratchet member being biased into engagement with said part by appropriate biasing means (50), the teeth being configured so that on relative rotation between said part and said ratchet member in one direction, said teeth engage, whereas on relative rotation in the opposite direction said teeth provide a camming effect, driving the ratchet member away from said part against said bias, to permit relative rotation between said part and said ratchet member.

18. A tool according to claim 17 wherein said ratchet member (42) is provided with means (51) which engage part (45) of the housing (27) of the tool to prevent rotation of the ratchet member relative to the housing, said means comprising co-operating projections and recesses which permit axial movement of the ratchet member.

19. A method of retrieving a drilling or production string from a well by lowering a tool into the well;

the tool comprising an assembly having means (12) to mount the assembly on a supporting string, means (56) within the assembly to drive a driven member (63) carried by the assembly, in response to vertical movement of the assembly, in a predetermined rotational direction, said driven member (63) being provided with or supporting a self-tapping thread (65) at the lowermost end of the assembly, the self-tapping thread having the same sense as said predetermined direction of rotation, the tool being suspended from a suspension unit (10) having means (14,15) to engage a casing (1,2,3) to prevent rotation of the suspension unit whilst permitting vertical movement of the tool;

effecting rotation of the self-tapping thread to secure engagement between the self-tapping thread and the uppermost part of the drilling or production string;

continuing to effect rotation of said self-tapping thread until part of the drilling or production string to be recovered is unscrewed from the remaining part thereof; and lifting the tool and the disconnected part of the drilling or production string to the surface.

* * * * *